United States Patent [19]

Taylor

[11] 4,409,451

[45] Oct. 11, 1983

[54] INDUCTION FURNACE HAVING IMPROVED THERMAL PROFILE

[75] Inventor: Kenneth E. Taylor, Longmeadow, Mass.

[73] Assignee: United Technologies Corporation, Hartford, Conn.

[21] Appl. No.: 297,900

[22] Filed: Aug. 31, 1981

[51] Int. Cl.[3] ..... H05B 6/30; H05B 6/40

[52] U.S. Cl. ..... 219/10.49 R; 219/10.43; 219/10.57; 373/157; 164/513; 164/507

[58] Field of Search ..... 219/10.49 R, 10.57, 219/10.43, 10.79, 10.67; 373/152, 153, 155, 156, 157, 162, 163, 164; 164/507, 513, 338.1, 122.1, 122.2, 123, 125, 126, 127

[56] References Cited

U.S. PATENT DOCUMENTS

| | | | |
|---|---|---|---|
| 2,773,923 | 12/1956 | Smith | 219/10.43 X |
| 3,260,505 | 7/1966 | Ver Snyder . | |
| 3,405,220 | 10/1968 | Barrow et al. | 164/122.1 X |
| 3,494,709 | 2/1970 | Piearcey . | |
| 3,538,981 | 11/1970 | Phipps, Jr. | 164/338.1 |
| 3,714,977 | 2/1973 | Terkelsen | 164/338.1 X |
| 3,754,110 | 8/1973 | Van Dongen et al. | 219/10.49 R |
| 3,793,010 | 2/1974 | Lemkey et al. . | |
| 3,931,847 | 1/1976 | Terkelsen | 164/122.1 X |
| 4,108,236 | 8/1978 | Salkeld | 164/513 |
| 4,202,400 | 5/1980 | Gigliotti, Jr. et al. | 219/10.49 R X |

*Primary Examiner*—C. C. Shaw
*Assistant Examiner*—Philip H. Leung
*Attorney, Agent, or Firm*—Robert C. Walker

[57] ABSTRACT

Apparatus for casting directionally solidified articles is disclosed. Concepts for obtaining a desired temperature profile in an induction furnace are discussed.

An induction furnace 10 has increased heating capacity at the withdrawal end 32 of the susceptor 28. A hot zone baffle 42 is disposed at the withdrawal end to inhibit the radiation of heat energy from the hot zone 12. A plurality of grooves 34 are formed about the interior of the susceptor at the withdrawal end to inhibit the conduction of heat energy out of the susceptor. A preferred thermal profile in the operating furnace with a peak temperature in close proximity to the withdrawal end results.

7 Claims, 2 Drawing Figures

10
40
30
28
20
16
38
12
36
18
18
34
44
32
42
26
14
22
24

INDUCTION FURNACE HAVING IMPROVED THERMAL PROFILE

Technical Field

This invention relates to induction heated casting furnaces, and particularly to furnaces capable of maintaining high end wall temperatures.

Background Art

The concepts were developed in the gas turbine engine industry for use in casting articles having directionally oriented grain structures. Apparatus capable of establishing a steep thermal gradient in a cast part being withdrawn from an induction furnace was sought and a specific object was to position the peak furnace temperature in close proximity to the withdrawal end of the furnace susceptor.

Directionally oriented grain structures to which the present concepts apply include those of the basic directional solidification technology described in U.S. Pat. No. 3,260,505 to Ver Snyder entitled "Gas Turbine Element"; those of the single crystal form of the technology described in U.S. Pat. No. 3,494,709 to Piearcey entitled "Single Crystal Metallic Part"; and those of eutectic alloy technology described in U.S. Pat. No. 3,793,010 to Lemkey et al. entitled "Directionally Solidified Eutectic Type Alloys with Aligned Delta Phase", all of common assignee herewith.

Such directionally oriented castings are fabricated in induction furnaces of the type described in U.S. Pat. Nos. 3,405,220 to Barrow et al. entitled "Induction Electric Mold Heater"; 3,538,981 to Phipps entitled "Apparatus for Casting Directionally Solidified Articles"; 3,714,977 to Terkelsen entitled "Method and Apparatus for the Production of Directionally Solidified Castings"; and 3,931,847 to Terkelsen entitled "Method and Apparatus for Production of Directionally Solidified Components", also all of common assignee herewith.

Disclosure of Invention

According to the present invention an induction furnace for casting articles having a directionally oriented grain structure is provided with a peak temperature capability in close proximity to the withdrawal end of the furnace. In accordance with one specific embodiment of the invention the conduction of heat energy out of the hot zone of the furnace is inhibited at the withdrawal end by disposing a plurality of circumferentially extending grooves about the interior of the susceptor in that region.

A primary feature of the present invention is the closely spaced plurality of grooves extending about the interior of the withdrawal end of the susceptor. In further detailed embodiments in combination with the closely spaced grooves, a radiation baffle is placed over the withdrawal end of the susceptor and a greater number of induction coil windings is provided in that region to enhance the peak temperature capability in close proximity to the withdrawal end.

A principal advantage of the present invention is the capability of the apparatus to establish an improved thermal profile along the susceptor. The peak temperature of the profile is positioned in close proximity to the withdrawal end of the susceptor. A sharp temperature gradient from the hot zone of the susceptor to the cold zone outside of the susceptor is established. A temperature differential capable of causing the desired directional solidification is provided over a short distance along the axis of withdrawal from the susceptor. Decreasing the distance over which the temperature differential is provided enables increased rates of travel through the temperature differential as the cast article is withdrawn from the furnace. A more time efficient casting process results.

The foregoing, and other objects, features and advantages of the present invention will become more apparent in the light of the following description of the best mode for carrying out the invention as illustrated in the accompanying drawing.

BEST MODE FOR CARRYING OUT THE INVENTION

The present invention was developed in the gas turbine engine industry for casting complex geometried articles, such as gas turbine blades and vanes, in which directional grain orientation is desired. The concepts are described with respect to that application.

Figure 1:
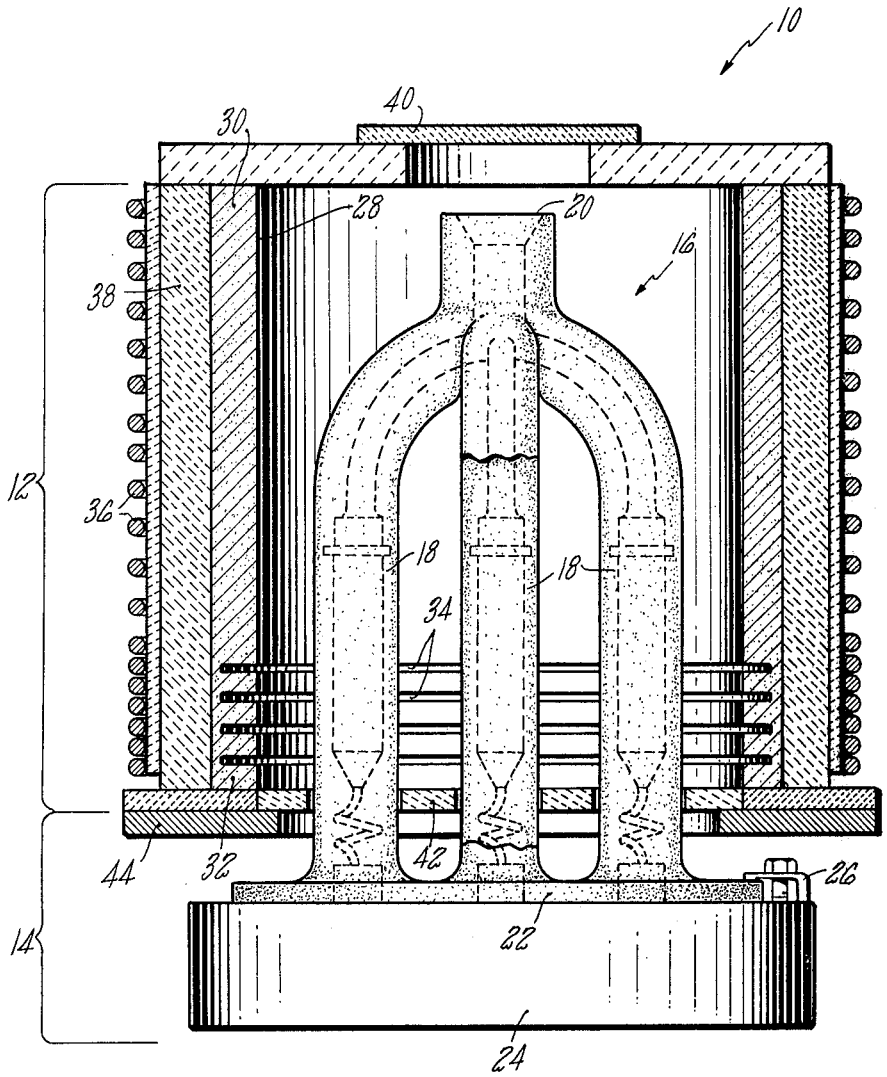
FIG. 1 is a cross section view through an induction heated, casting furnace incorporating the concepts of the present invention.

A casting furnace 10 incorporating the invention is shown in cross section in FIG. 1. The furnace is separated, for purposes of discussion, into a hot zone 12 and a cold zone 14. A casting mold 16 configured to produce a plurality of rotor blades 18 is shown within the hot zone. The top end 20 of the mold is open to permit the pour of molten alloy into the mold. The bottom 22 of the mold is affixed to a chill plate 24 in the cold zone of the furnace. An attaching clamp 26 is illustrated.

The hot zone 12 includes a graphite susceptor 28 having a pour end 30 and a withdrawal end 32. A plurality of grooves 34 are formed in the withdrawal end of the susceptor and extend circumferentially about the interior thereof. An induction heating coil 36 is disposed about the susceptor. In a preferred form as shown, the induction coil has a greater heating capacity near the withdrawal end of the susceptor than at the pour end. A greater number of coil windings in that region provide the greater heating capability. An insulating material 38 is disposed about the exterior of the susceptor to retain heat generated therein. A movable cover plate 40 covers the pour end of the susceptor. A hot zone baffle 42 covers the withdrawal end of the susceptor, separating the hot zone 12 from the cold zone 14. The hot zone rests upon a base plate 44.

The hot zone baffle 42 preferably extends into close proximity with the casting mold 16 in order to prevent the radiation of heat energy from components in the hot zone. The chill plate 24 and the casting mold 16 affixed thereto are capable of movement relative to the hot zone 12, in and out of the withdrawal end 28 of the susceptor.

Figure 2:
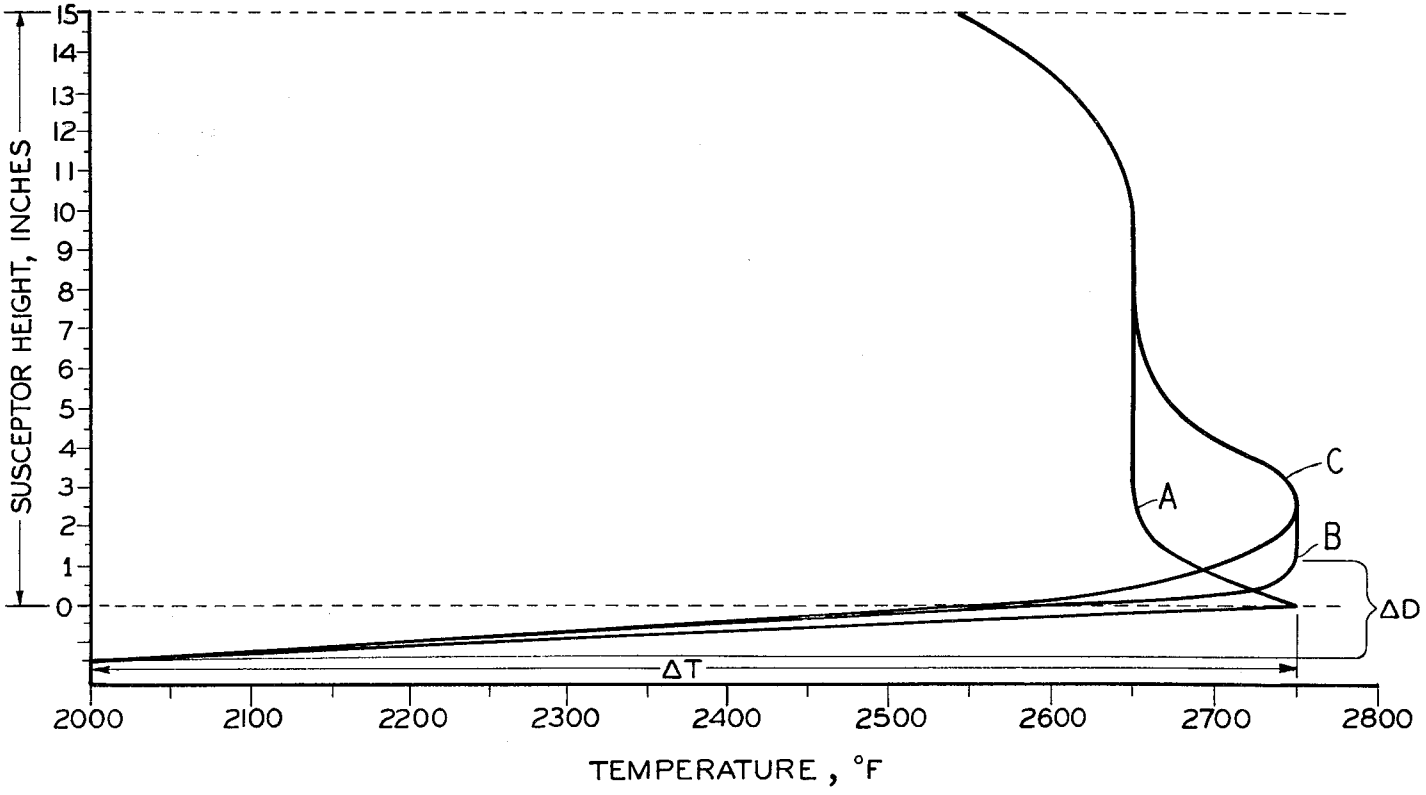
FIG. 2 is a graph comparing the thermal profile characteristic of a susceptor constructed in accordance with the present invention to that of susceptors not incorporating the concepts.

During a representative operation of the casting furnace 10 in the fabrication of gas turbine rotor blades from nickel base superalloy material, the mold 16 is placed in position on the chill plate 24 and is inserted into the hot zone 12 of the furnace. The induction coil 36 is energized causing the temperature of the susceptor 28 to rise. Heat energy is radiated from the susceptor to the mold until a stable temperature profile having the characteristic shape of profile B illustrated in FIG. 2 is reached. The furnace and mold are ready for pour.

The cover plate 40 is removed and molten alloy is pourred into the mold. The alloy containing mold is slowly with drawn from the hot zone. Solildification of the alloy at the chill plate initiates and progresses upwardly into the mold as the mold is withdrawn from the hot zone.

An ideal thermal profile is represented by the profile A of FIG. 2, comparing susceptor height in inches to hot zone temperature in degrees Fahrenheit. The profile B of FIG. 2 represents the profile achievable with the concepts of the present invention. The temperatures indicated are for use with a nickel base superalloy material having a solidus temperature of two thousand three hundred seventy-seven degrees Fahrenheit (2377° F.), such as PWA 1480 alloy (an alloy designation of Pratt & Whitney Aircraft Division of United Technologies Corporation). A peak temperature of two thousand seven hundred fifty degrees Fahrenheit (2750° F.) is reached at the withdrawal end of the susceptor. The temperature must be sufficiently high to maintain the alloy in the molten condition and, specifically, to insure that no grain growth exists within the alloy before the mold is withdrawn from the hot zone. Notwithstanding, excessive temperatures of long duration may undesirably result in degradation of the mold material and contamination of the alloy melt. Exposing the alloy to a peak temperature of short duration balances the need for high temperature with the need for avoiding mold degradation.

In accordance with a second requirement the profile must have a sharply decreasing temperature at the withdrawal end of the susceptor. For effective casting a sharp temperature gradient in the alloy as the alloy is withdrawn from the hot zone and solidified must be maintained. The sharpness of the temperature gradient in the alloy being solidified is in part a function of the furnace temperature drop $\Delta T$ and of the distance $\Delta D$ over which that drop occurs. Prior to withdrawal the alloy thermal profile matches the thermal profile of the furnace. The sharpness of the gradient in the alloy is further a function of the rate of withdrawal of the solidifying alloy from the hot zone: increasing rates of withdrawal decreasing the steepness of the gradient in the alloy. The present concepts enable increased rates of withdrawal by decreasing the distance $\Delta D$ over which the furnace temperature decrease by the amount $\Delta T$.

The profile curve C represents that attainable with addition of increased amounts of heating capacity at the withdrawal end of the susceptor. The peak temperature as illustrated begins to deteriorate at approximately twenty percent (20%) of the susceptor height as a result of radiation and conduction from the end of the susceptor. In the FIG. 1 apparatus, the radiation of heat energy from the hot zone is inhibited by the hot zone baffle 42. The grooves 34 in the susceptor inhibit the conduction of heat energy from the hot zone through the withdrawal end of the susceptor. In such a construction deterioration from the peak temperature is delayed to below ten percent (10%) of the susceptor height.

In specific detail a graphite susceptor for fabricating rotor blades having an axial length of approximately six (6) inches had a height of fifteen (15) inches and an inside diameter of twelve and one-half ($12\frac{1}{2}$) inches. The susceptor wall thickness was one (1) inch. Four (4) grooves of one-eighth ($\frac{1}{8}$) inch were cut into the susceptor as illustrated to a depth of seven-eighths ($\frac{7}{8}$) inches on centers of one-half ($\frac{1}{2}$) inch. The grooves extended over approximately fifteen percent (15%) of the susceptor height from the withdrawal end. The thermal profile B of FIG. 2 was established in the susceptor. A withdrawal rate from the susceptor of five inches per hour (5 in/hr) produced acceptable parts from molten PWA 1480 material. A gradient of three hundred sixty degrees Fahrenheit per inch (360° F./in) was maintained in the solidifying alloy.

Although the invention has been shown and described with respect to preferred embodiments thereof, it should be understood by those skilled in the art that various changes and omissions in the form and detail thereof may be made therein without departing from the spirit and the scope of the invention.

I claim:

1. In a casting furnace of the type suited to the production of directionally solidified articles by a withdrawal process and having a cylindrical susceptor with a pour end and a withdrawal end surrounded by induction heating coils, the improvement which comprises:

means for establishing a temperature profile within the furnace which is characterized by a peak temperature in close proximity to the withdrawal end of the furnace including a plurality of grooves extending circumferentially about the interior of the withdrawal end of the susceptor for inhibiting the conduction of heat energy out of the furnace at the withdrawal end of the susceptor.

2. The invention according to claim 1 which further includes a hot zone baffle disposed at the withdrawal end of the susceptor for inhibiting the radiation of heat energy from the withdrawal end of the furnace.

3. The invention according to claim 2 which further includes an induction heating coil disposed about the cylindrical susceptor wherein the induction heating coil has a greater heating capacity at the withdrawal end of the susceptor than at the pour end.

4. The invention according to claim 1, 2 or 3 wherein the susceptor is fabricated of graphite and has a thickness on the order of one (1) inch and wherein the grooves are cut into the susceptor to a depth of approximately seven eighths ($\frac{7}{8}$) inches.

5. The invention according to claim 4 wherein the susceptor has an inside diameter on the order of twelve and one-half ($12\frac{1}{2}$) inches and a height on the order of fifteen (15) inches.

6. The invention according to claim 5 wherein the grooves are spaced on centers of approximately one-half ($\frac{1}{2}$) inch and wherein the width of each groove is approximately one-eighth ($\frac{1}{8}$) inch.

7. The invention according to claim 1, 2 or 3 wherein the grooved portion of the susceptor extends over approximately fifteen percent (15%) of the height of the susceptor.

* * * * *